US008007229B2

(12) United States Patent
McCaffrey et al.

(10) Patent No.: US 8,007,229 B2
(45) Date of Patent: Aug. 30, 2011

(54) VARIABLE AREA TURBINE VANE ARRANGEMENT

(75) Inventors: Michael G. McCaffrey, Windsor, CT (US); John R. Farris, Bolton, CT (US); Eric A. Hudson, Harwinton, CT (US); George T. Suljak, Jr., Vernon, CT (US)

(73) Assignee: United Technologies Corporation, Hartford, CT (US)

( * ) Notice: Subject to any disclaimer, the term of this patent is extended or adjusted under 35 U.S.C. 154(b) by 0 days.

(21) Appl. No.: 12/778,084

(22) Filed: May 11, 2010

(65) Prior Publication Data

US 2010/0247293 A1 Sep. 30, 2010

Related U.S. Application Data

(63) Continuation-in-part of application No. 11/752,945, filed on May 24, 2007.

(51) Int. Cl.
*F01D 17/16* (2006.01)

(52) U.S. Cl. ..... 415/161; 415/191; 415/211.2; 415/209.3; 29/889.22

(58) Field of Classification Search ..... 415/159–165, 415/191, 211.2, 209.3; 29/889.22
See application file for complete search history.

(56) References Cited

U.S. PATENT DOCUMENTS

| | | | | |
|---|---|---|---|---|
| 2,819,732 | A * | 1/1958 | Paetz | 138/46 |
| 2,994,509 | A * | 8/1961 | Walker | 415/159 |
| 3,966,352 | A * | 6/1976 | White et al. | 415/115 |
| 4,990,056 | A * | 2/1991 | McClain et al. | 415/160 |
| 5,165,849 | A * | 11/1992 | Nakagawa et al. | 415/208.1 |
| 5,690,469 | A * | 11/1997 | Deal et al. | 415/189 |
| 5,931,636 | A | 8/1999 | Savage et al. | |
| 6,419,464 | B1 | 7/2002 | Arnold | |
| 6,536,216 | B2 | 3/2003 | Halila et al. | |
| 6,629,817 | B2 | 10/2003 | Shelton et al. | |
| 6,681,558 | B2 | 1/2004 | Orlando et al. | |
| 6,984,105 | B2 * | 1/2006 | Clark et al. | 415/160 |
| 7,116,839 | B2 | 10/2006 | Leboeuf | |
| 7,134,271 | B2 | 11/2006 | Baughman et al. | |
| 7,264,441 | B2 * | 9/2007 | Loudet | 415/144 |
| 2007/0020094 | A1 * | 1/2007 | Giaimo et al. | 415/160 |

FOREIGN PATENT DOCUMENTS

FR 2583820 A1 * 12/1986

* cited by examiner

*Primary Examiner* — Ninh H Nguyen
*Assistant Examiner* — Liam McDowell
(74) *Attorney, Agent, or Firm* — Carlson Gaskey & Olds P.C.

(57) ABSTRACT

A ring vane nozzle for a gas turbine engine according to an exemplary aspect of the present disclosure includes a multiple of fixed turbine vanes between an inner vane ring and an outer vane ring and a multiple of rotational turbine vanes between the inner vane ring and the outer vane ring, each of the rotational turbine vanes rotatable about an axis of rotation.

12 Claims, 6 Drawing Sheets

FIG.6

VARIABLE AREA TURBINE VANE ARRANGEMENT

REFERENCE TO RELATED APPLICATIONS

The present disclosure is a continuation-in-part application to U.S. patent application Ser. No. 11/752,945, filed 24 May 2007.

BACKGROUND

The present disclosure relates to a gas turbine engine turbine section, and more particularly to a variable area turbine in which alternate vanes rotate to modulate turbine throat area.

Typical turbine nozzles, such as high pressure and low pressure turbine nozzles, have fixed vane configurations and fixed turbine nozzle throat areas. Variable cycle engines are being developed to maximize performance and efficiency over subsonic and supersonic flight conditions. Some engines provide variability by mounting each vane on a radial spindle and collectively rotating each row of compressor vanes with an annular unison ring.

SUMMARY

A ring vane nozzle for a gas turbine engine according to an exemplary aspect of the present disclosure includes a multiple of fixed turbine vanes between an inner vane ring and an outer vane ring and a multiple of rotational turbine vanes between the inner vane ring and the outer vane ring, each of the rotational turbine vanes rotatable about an axis of rotation.

A ring vane nozzle for a gas turbine engine according to an exemplary aspect of the present disclosure includes a multiple of fixed turbine vanes between an inner vane ring and an outer vane ring, the multiple of fixed turbine vanes interspersed with a multiple of spaces.

BRIEF DESCRIPTION OF THE DRAWINGS

The various features and advantages of this invention will become apparent to those skilled in the art from the following detailed description of the currently disclosed embodiment. The drawings that accompany the detailed description can be briefly described as follows.

DETAILED DESCRIPTION

Figure 1:
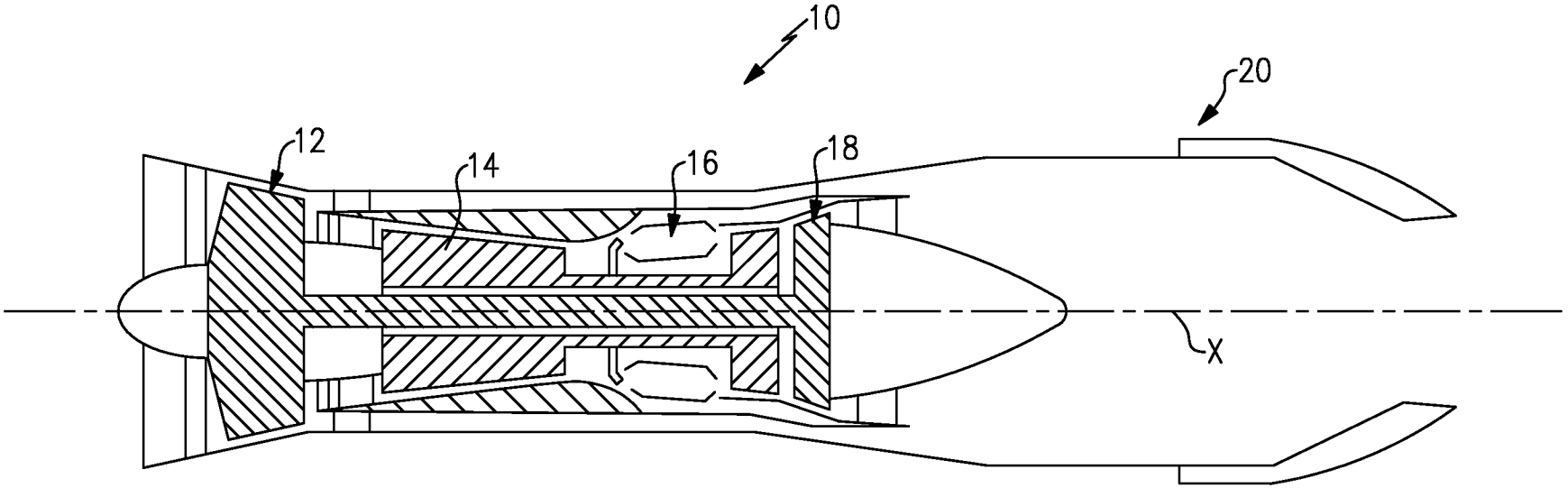
FIG. 1 is a general schematic view of an exemplary gas turbine engine embodiment for use with the present disclosure.

FIG. 1 schematically illustrates a gas turbine engine 10 which generally includes a fan section 12, a compressor section 14, a combustor section 16, a turbine section 18, and a nozzle section 20 along a longitudinal axis X. The gas turbine engine 10 of the disclosed embodiment is a relatively low bypass gas turbine engine. It should be understood that although a low bypass gas turbine engine is schematically illustrated, other gas turbine engines including geared architecture engines, direct drive turbofans, turboshaft engines and others will benefit from the disclosure.

The engine 10 is configured to provide a variable area turbine nozzle to selectively control the flow of combustion gas from the combustor section 16 through the turbine section 18. The engine 10 includes a variable vane geometry within, for example, the High Pressure Turbine (HPT), Intermediate Turbine (IT), the Low Pressure Turbine (LPT) modules (not shown) and combinations thereof—all located within the turbine section 18.

Figure 2:
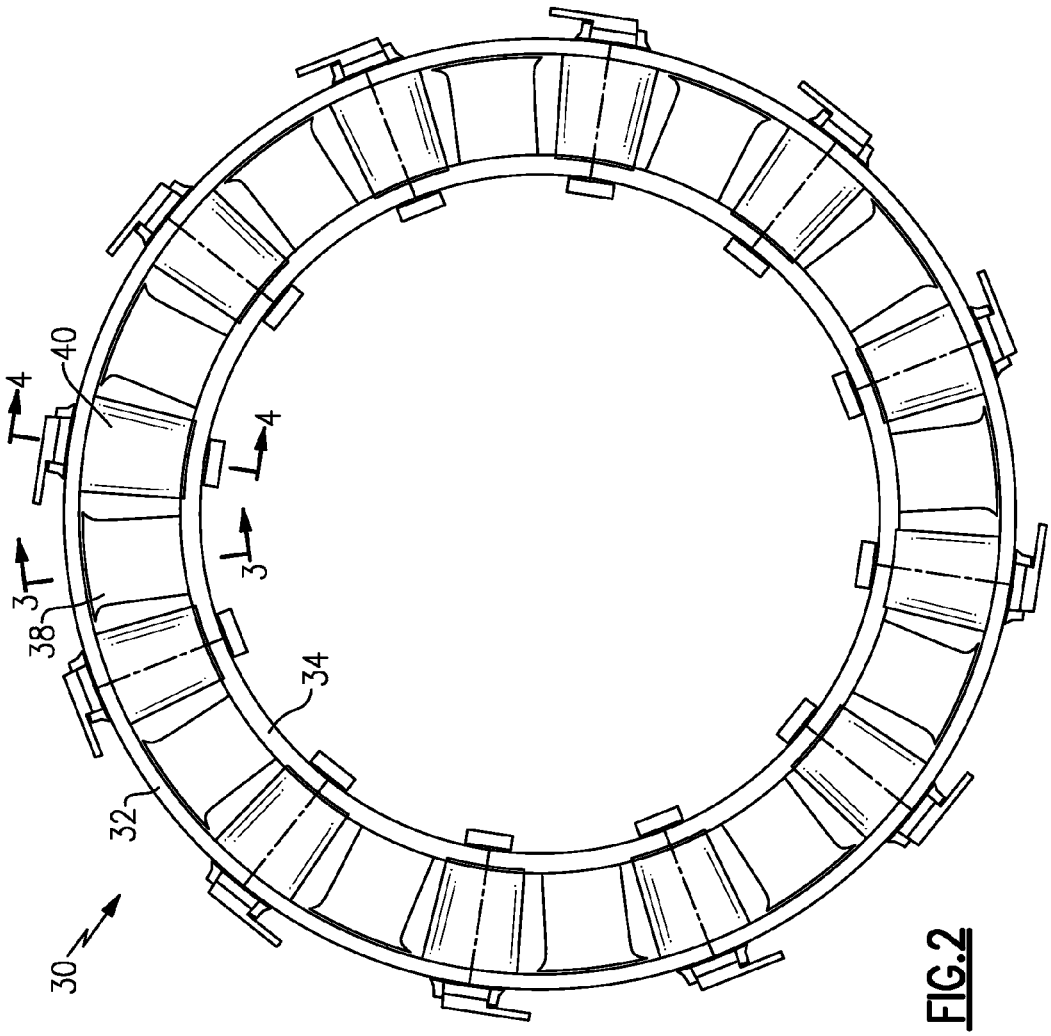
FIG. 2 is an expanded front view of a full ring vane nozzle of one turbine stage within a turbine section of the gas turbine engine.

Referring to FIG. 2, a full ring vane nozzle 30 includes an outer diameter vane ring 32 and an inner diameter vane ring 34 defined about the engine axis X such that the outer diameter vane ring 32 and the inner diameter vane ring 34 are radially separated. The outer diameter vane ring 32 may form a portion of an outer core engine structure and the inner diameter vane ring 34 may form a portion of an inner core engine structure to at least partially define an annular gas flow path.

Figure 3:
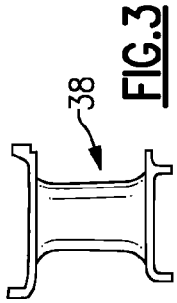
FIG. 3 is a sectional view of a fixed turbine vane.
Figure 4:
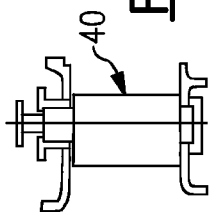
FIG. 4 is a sectional view of a rotational turbine vane.
Figure 5:
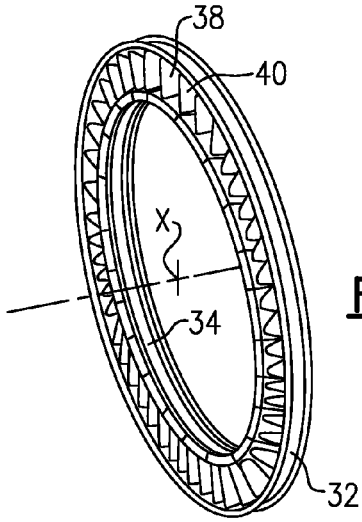
FIG. 5 is a perspective view of a full ring vane nozzle of one turbine stage within a turbine section of the gas turbine engine.

The full ring vane nozzle 30 includes a multiple of circumferentially spaced apart turbine vanes 38, 40 which extend radially between the vane rings 32, 34. The full ring vane nozzle 30 includes a multiple of fixed turbine vanes 38 (FIG. 3) and a multiple of rotational turbine vanes 40 (FIG. 4) to provide a rigid structural assembly which accommodates thermal and aerodynamic loads during operation. The full, annular ring of the full ring vane nozzle 30 (also shown in FIG. 5) provides a vane portion of one stage in the turbine section 18.

The full ring vane nozzle 30 may be cast in one 360 degree piece with the outer diameter vane ring 32 and the inner diameter vane ring 34 having the fixed turbine vanes 38 cast therebetween with every other airfoil location—where the rotational turbine vanes 40 will be located. In the disclosed embodiment, each one of the multiple of fixed turbine vanes 38 alternates with each one of the multiple of rotational turbine vanes 40. It should be understood, however, that any number of the multiple of fixed turbine vanes 38 may be interspersed with the rotational turbine vanes 40. That is, other non-limiting embodiments may include two or more fixed turbine vanes 38 interspersed between each rotational turbine vane 40.

Figure 6:
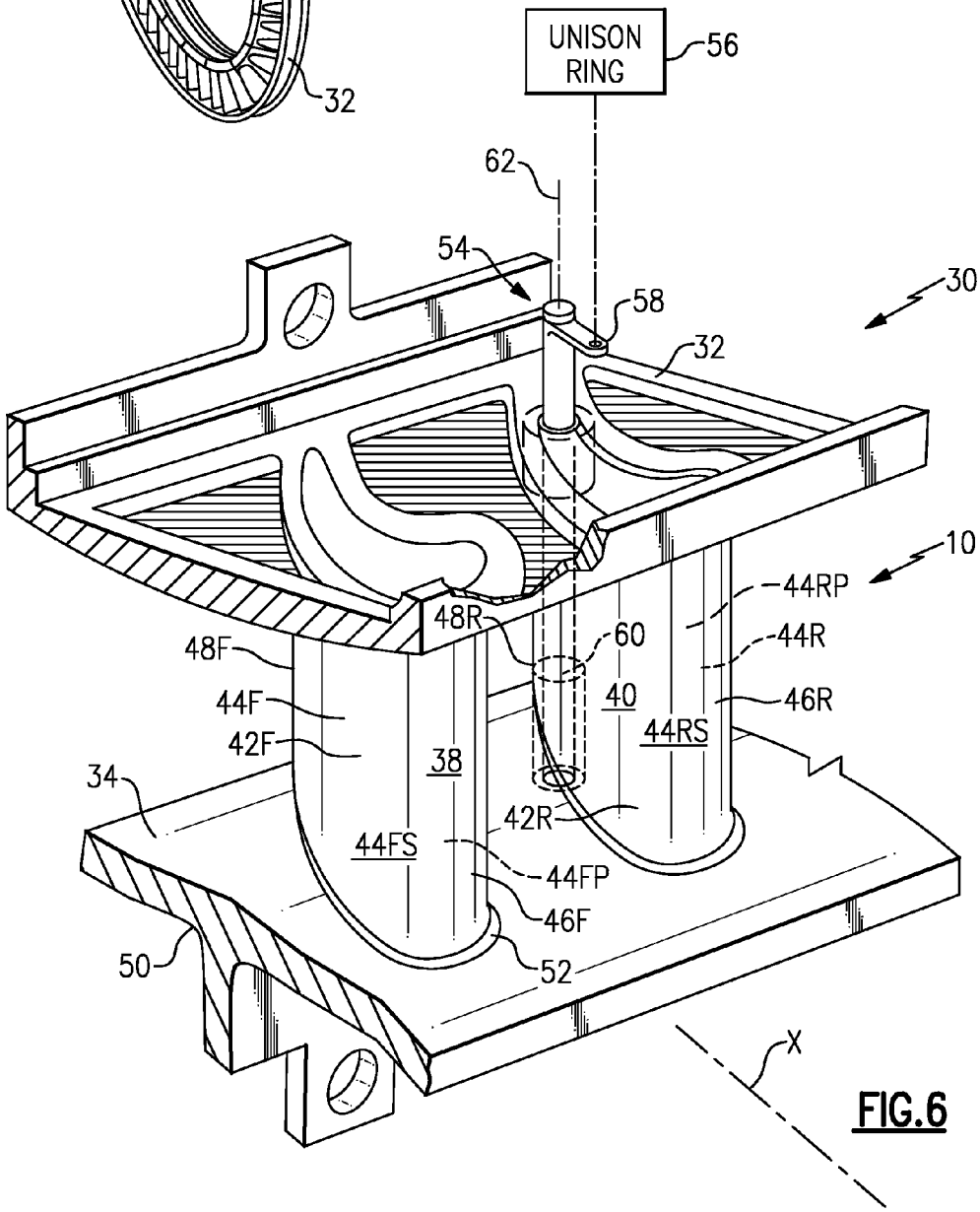
FIG. 6 is an expanded perspective view of a section of the full ring vane nozzle.

Referring to FIG. 6, a section of the full ring vane nozzle 30 is illustrated. Each turbine vane 38, 40 includes a respective airfoil portion 42F, 42R defined by an outer airfoil wall surface 44F 44R between the leading edge 46F, 46R and a trailing edge 48F, 48R. Each turbine vane 38, 40 may include a fillet 52 to provide a transition between the airfoil portion 42F, 42R and the vane rings 32, 34. The outer airfoil wall surface 44F, 44R is typically shaped for use in a HPT, IT, or LPT of the turbine section 18. The outer airfoil wall surface 44F, 44R typically have a generally concave shaped portion forming a pressure side 44FP, 44RP and a generally convex shaped portion forming a suction side 44FS, 44RS. It should be understood that respective airfoil portion 42F, 42R defined by the outer airfoil wall surface 44F 44R may be generally equivalent or separately tailored to optimize flow characteristics and transient thermal expansion issues.

An actuator system 54 includes an actuator such as an outer diameter unison ring (illustrated schematically at 56) which rotates an actuator arm 58 and thereby a spindle 60 of each rotational turbine vane 40. The spindle 60 rotates each rotational turbine vane 40 about a vane axis of rotation 62 relative the adjacent fixed turbine vanes 38 to selectively vary the turbine nozzle throat area. That is, movement of the rotational turbine vanes 40 relative the adjacent fixed turbine vanes 38 effectuates a change in throat area of the full ring vane nozzle 30. The spindle 60 may additionally facilitate cooling airflow into each rotational turbine vane 40 through, in on non-limiting embodiment, a hollow spindle 60. It should be understood that various cooling arrangements may alternatively or additionally be provided.

The fixed turbine vane 38 provides a structural tie between the vane rings 32, 34 without internal seals or moving parts. Since the fixed turbine vane 38 and vane rings 32, 34 provide a rigid structure, the rotational turbine vane 40 may include a relatively less complicated rotation, support and sealing structure to provide the variable nozzle throat area capability which minimizes turbine pressure loss, leakage, expense and weight. The ring structure of the full ring vane nozzle 30 also readily transmits load between the inner structure and the outer structure of the engine 10 without transmitting loads through the rotational components.

Figure 7:
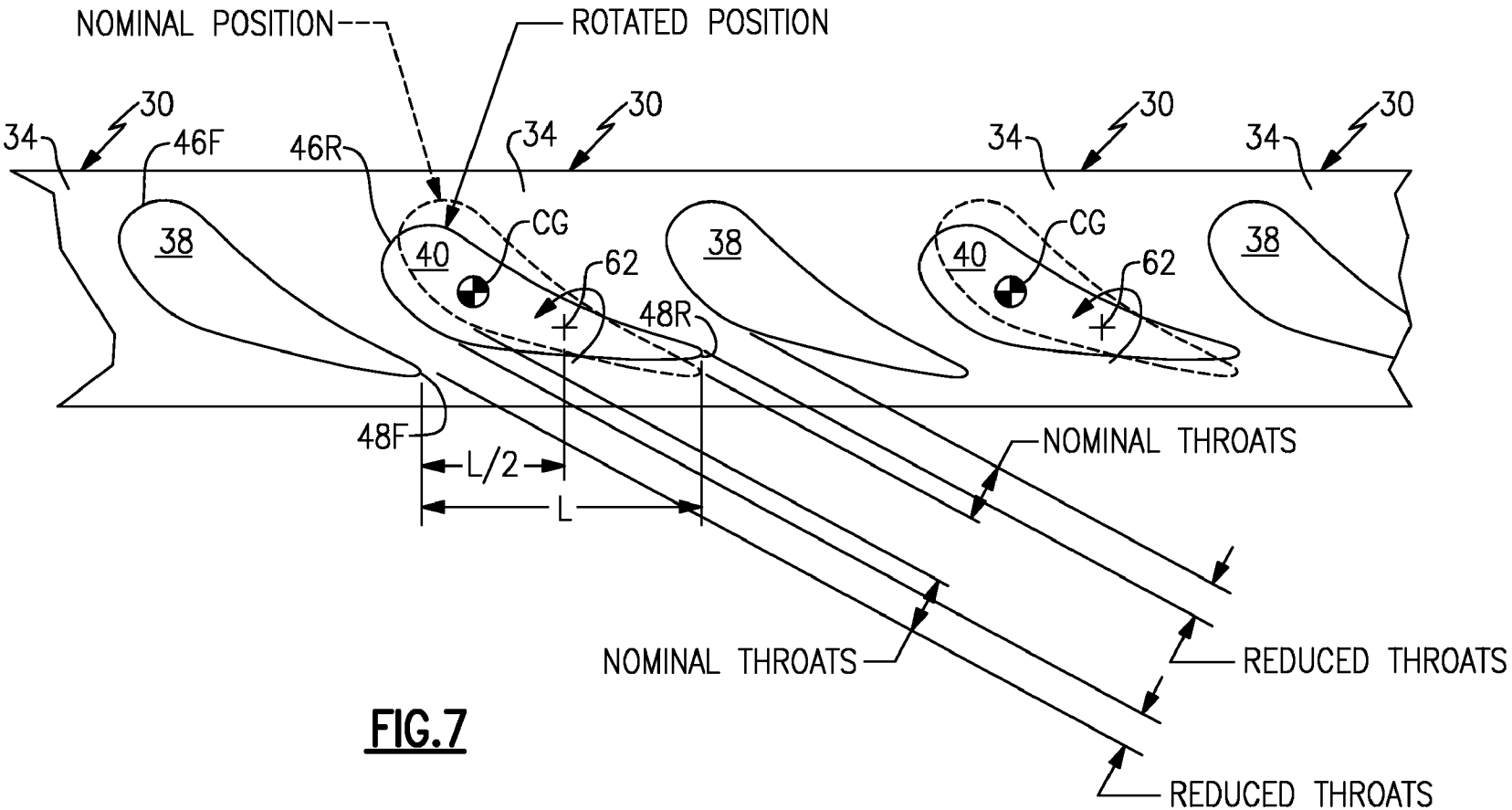
FIG. 7 is a top schematic representation of the throat change performed by the turbine section.

In FIG. 7, the vane axis of rotation 62 may be located approximately midway between the trailing edges of an adjacent fixed turbine vanes 38 and rotational turbine vane 40 to selectively close the throat area between the rotational turbine vane 40 and the adjacent fixed turbine vanes 38 on either side of the rotational turbine vane 40. It should be understood that various rotational and positional schemes may benefit herefrom. Airfoils are conventionally rotated around the geometric center of gravity (CG) of the airfoil cross section. Here, the rotational turbine vane 40 vane axis of rotation 62 may be biased toward the trailing edge 48R of the rotational turbine vane 40. In one embodiment, a distance L is defined between the trailing edges of an adjacent fixed turbine vanes 38 and rotational turbine vane 40. The rotational turbine vane 40 axis of rotation 62 is then positioned at L/2 from each adjacent fixed turbine vane 38 such that the axis of rotation 62 is located axially aft of the conventional geometric CG.

Figure 8:
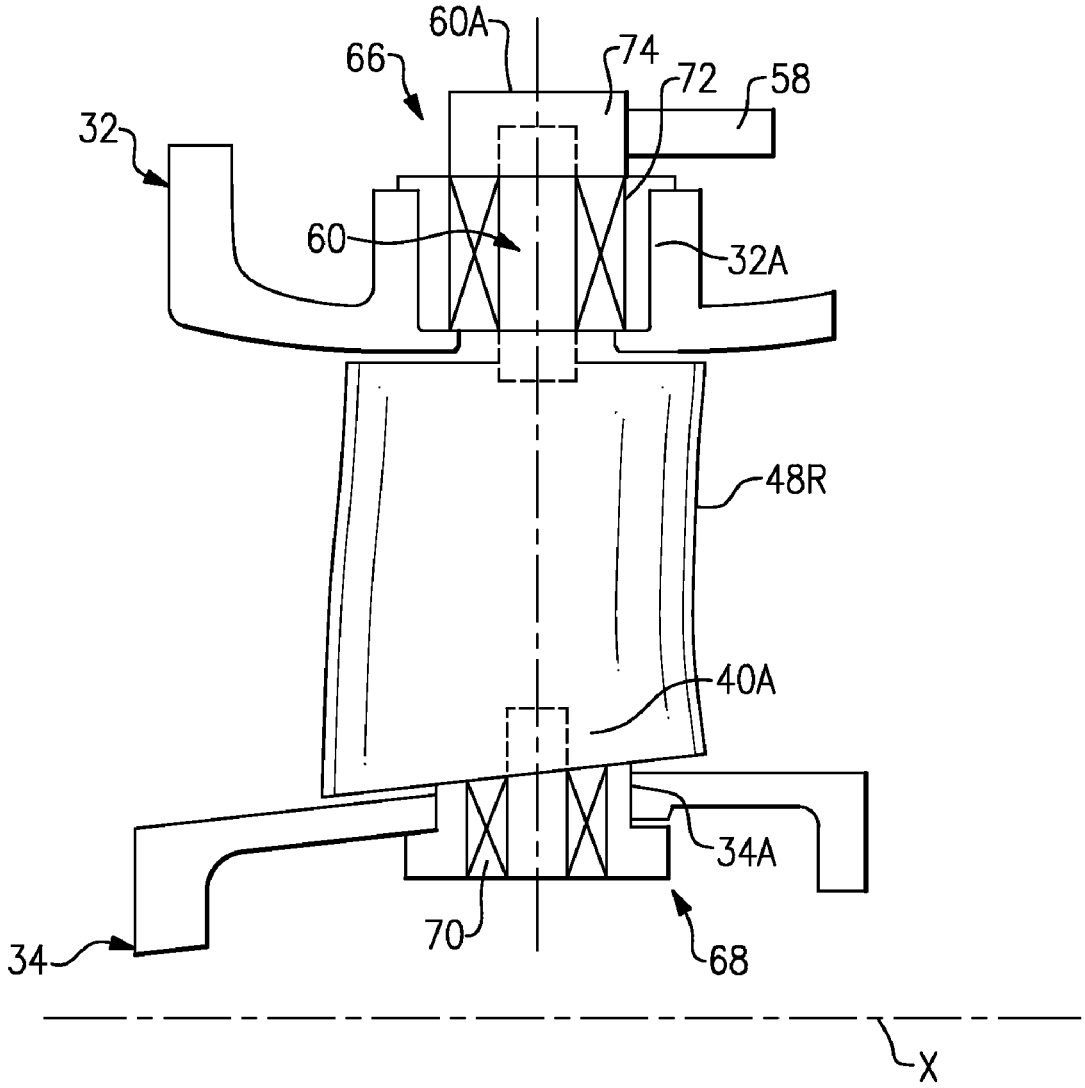
FIG. 8 is a side sectional view of a rotational turbine vane.

With reference to FIG. 8, the outer diameter vane ring 32 and the inner diameter vane ring 34 include a respective aperture 32A, 34A to receive a rotational support assembly 66, 68 for the rotational turbine vane 40. It should be understood that various other support arrangements may alternately or additionally be provided. In the disclosed non-limiting embodiment, the inner diameter rotational support assembly 68 includes a bearing cartridge 70 and the outer diameter rotational support assembly 66 includes a bearing assembly 72 and a fastener 74 which are received onto a spindle section 60A.

Figure 9:
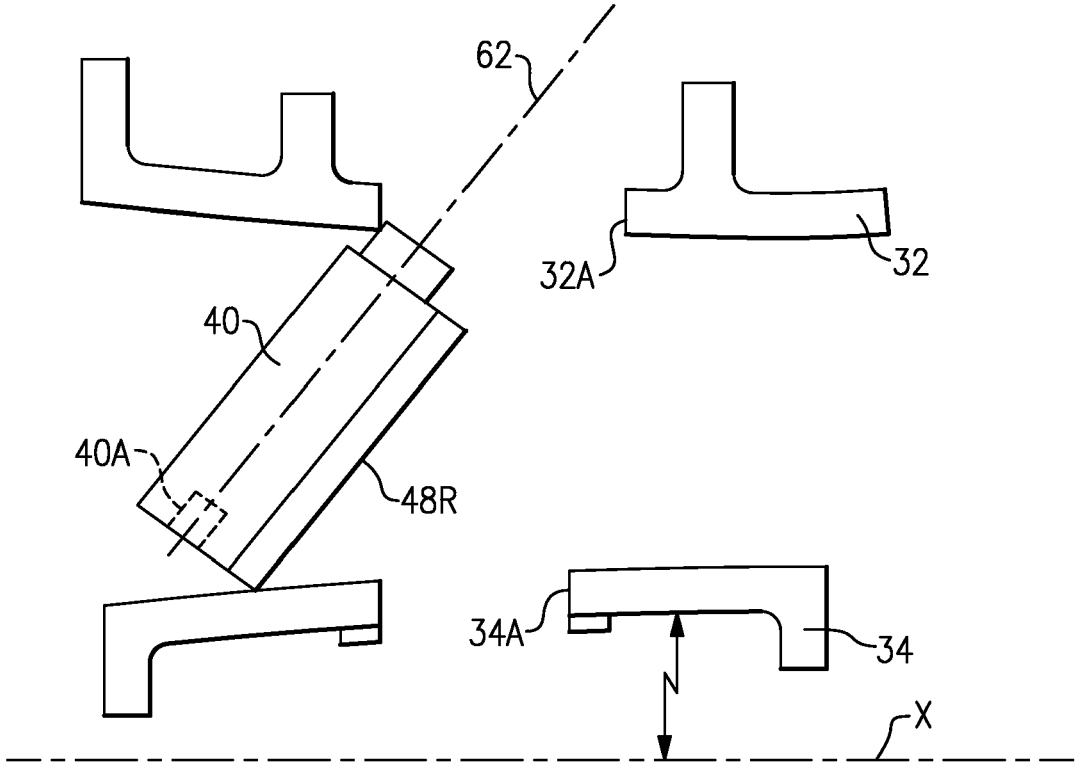
FIG. 9 is a side sectional view of a rotational turbine vane being installed into the full ring vane nozzle.

Referring to FIGS. 8 and 9, to assemble each rotational turbine vane 40 into the vane rings 32, 34 which are separated by a fixed distance, the rotational turbine vane 40 is rotated and angled such that the spindle section 60A is received into the aperture 32A. The aperture 32A may be of a relatively enlarged diameter as compared to conventional arrangements to accommodate the angled insertion arrangement with the bearing assembly 72 sized to close the aperture 32A. That is, the bearing assembly 72 is enlarged and may include seal features to close aperture 32A. The fastener 74 is received on the spindle section 60A and may include the actuator arm 58 (FIG. 6) or other features. The bearing cartridge 70 is received through the aperture 34A and into a pocket 40A formed in the rotational turbine vane 40 to rotationally retain the rotational turbine vane 40 between the outer diameter vane ring 32 and the inner diameter vane ring 34. It should be understood that various mount, support, seal, and actuator arrangements may alternately or additionally be provided.

In operation, rotation of the rotational turbine vanes 40 between a nominal position and a rotated position selectively changes the turbine nozzle throat area as each rotational turbine vane 40 concurrently changes the throat area between itself and the adjacent fixed turbine vanes 38. Since only half the vanes are rotated, the complexity and load requirements of the actuator system 54 are reduced. It should be understood that the angle of rotation may be larger for each rotational turbine vane 40, however, the air exit angle may be different for each side of the rotational turbine vane 40. Through Computational Flow Dynamics, however, this difference is known and may be utilized to provide an airfoil shape that addresses this differential flow behavior. The alternating rotational-fixed vane arrangement also facilitates a relatively less complicated rotation, support and sealing structure to provide the variable nozzle throat area capability to minimize turbine pressure loss, leakage, expense and weight.

The present disclosure reduces moving parts and endwall losses typical of other systems yet provides an effective structural tie between the outer to inner flowpath. Since the entire rotational turbine vane 40 rotates—rather than a section thereof—there are no discontinuities in the airfoil surface to penalize efficiency and require cooling purge flow. Furthermore, the integrity of the airfoils is not dependent on the wear of relatively small moving parts and seals inside the vanes. Extensive steady and unsteady CFD studies have shown the aerodynamic risks of the alternating vane system are low, and the resultant aero-elastic environment is predictable with existing tools. The alternating vane geometry also provides the unique possibility of influencing the aero-elastic driver amplitude for the primary vane count frequency and half vane count frequency as a function of vane actuation.

It should be understood that relative positional terms such as "forward," "aft," "upper," "lower," "above," "below," and the like are with reference to the normal operational attitude of the device and should not be considered otherwise limiting.

It should be understood that although a particular component arrangement is disclosed in the illustrated embodiment, other arrangements will benefit from the instant invention.

Although particular step sequences are shown, described, and claimed, it should be understood that steps may be performed in any order, separated or combined unless otherwise indicated and will still benefit from the present invention.

The foregoing description is exemplary rather than defined by the limitations within. Many modifications and variations of the present disclosure are possible in light of the above teachings. The disclosed embodiments of this invention have been disclosed, however, one of ordinary skill in the art would recognize that certain modifications would come within the scope of this invention. It is, therefore, to be understood that within the scope of the appended claims, the invention may be practiced otherwise than as specifically described. For that reason the following claims should be studied to determine the true scope and content of this invention.

What is claimed is:

1. A full ring vane nozzle for a gas turbine engine comprising:

an inner vane ring with a multiple of inner apertures;

an outer vane ring with a multiple of outer apertures;

a multiple of fixed turbine vanes between said inner vane ring and said outer vane ring; and a multiple of rotational turbine vanes having a pocket and a spindle section along an axis of rotation, said multiple of rotational turbine vanes mountable between said inner vane ring and said outer vane ring, each of said multiple of rotational turbine vanes rotatable about said axis of rotation defined by a respective pair of said multiple of inner apertures and said multiple of outer apertures, said multiple of inner apertures and said multiple of outer apertures each sized to receive one of said multiple of rotational turbine vanes at an angle with respect to said inner vane ring and said outer vane ring.

2. The full ring vane nozzle as recited in claim 1, wherein said multiple of fixed turbine vanes alternate with said multiple of rotational turbine vanes.

3. The full ring vane nozzle as recited in claim 1, wherein said axis of rotation of each of said multiple of rotational turbine vanes is aft of a geometric center of gravity of a cross section of said rotational turbine vane.

4. The full ring vane nozzle as recited in claim 1, wherein said axis of rotation of each of said multiple of rotational turbine vanes is located approximately midway between a trailing edge of said fixed turbine vane and a trailing edge of said rotational turbine vane.

5. The full ring vane nozzle as recited in claim 1, wherein said respective apertures of said multiple of inner apertures and said multiple of outer apertures each receive one of a cartridge bearing and a bearing.

6. The full ring vane nozzle as recited in claim 1, wherein said angle is with respect to said axis of rotation.

7. The full ring vane nozzle as recited in claim 1, wherein each of said multiple of rotational turbine vanes are receivable into a respective pair of said multiple of inner apertures and said multiple of outer aperture at said angle which is off said axis of rotation.

8. A method of assembling a vane nozzle for a gas turbine engine comprising:

placing a multiple of fixed turbine vanes between an inner vane ring and an outer vane ring;

receiving each of a multiple of rotational turbine vanes at an angle with respect to the inner vane ring and the outer vane ring, each of the multiple of rotational turbine vanes rotatable about an axis of rotation defined by a respective pair of a multiple of inner apertures within the inner vane ring and a multiple of outer apertures within the outer vane ring, the multiple of inner apertures and the multiple of outer apertures are larger than a pocket and a spindle section of each of the multiple of rotational turbine vanes.

9. The method as recited in claim 8, further comprising:

receiving one of a cartridge bearing and a bearing assembly within each of the multiple of inner apertures and the multiple of outer apertures.

10. The method as recited in claim 9, further comprising:

receiving the cartridge bearing and a bearing assembly within each of the multiple of inner apertures and the multiple of outer apertures.

11. The method as recited in claim 9, further comprising:

receiving the bearing cartridge through one of the multiple of inner apertures and the multiple of outer apertures and into the pocket.

12. The method as recited in claim 9, further comprising:

receiving the bearing assembly through one of the multiple of inner apertures and the multiple of outer apertures and onto the spindle section.

* * * * *